US009010921B2

(12) United States Patent
Kumai

(10) Patent No.: US 9,010,921 B2
(45) Date of Patent: Apr. 21, 2015

(54) PRINTING APPARATUS

(71) Applicant: Seiko Epson Corporation, Tokyo (JP)

(72) Inventor: Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/058,103

(22) Filed: Oct. 18, 2013

(65) Prior Publication Data

US 2014/0111586 A1 Apr. 24, 2014

(30) Foreign Application Priority Data

Oct. 19, 2012 (JP) ..... 2012-232420

(51) Int. Cl.

*B41J 2/01* (2006.01)
*B41J 29/02* (2006.01)
*B41J 11/00* (2006.01)

(52) U.S. Cl.

CPC ..... *B41J 29/023* (2013.01); *B41J 11/002* (2013.01)

(58) Field of Classification Search

CPC ..... B41J 11/002; B41J 11/0015; B41J 2/01; B41M 7/0072; C09D 11/101
USPC ..... 347/102, 108, 109
See application file for complete search history.

(56) References Cited

U.S. PATENT DOCUMENTS

| | | | | |
|---|---|---|---|---|
| 5,711,517 | A * | 1/1998 | Kelly | 271/4.01 |
| 2003/0169322 | A1 | 9/2003 | Shima et al. | |
| 2005/0016073 | A1 * | 1/2005 | Petta et al. | 49/504 |
| 2009/0073211 | A1 * | 3/2009 | Imoto | 347/16 |
| 2011/0033198 | A1 * | 2/2011 | Sasahara et al. | 399/92 |
| 2011/0037819 | A1 | 2/2011 | Mizutani | |
| 2011/0070005 | A1 * | 3/2011 | Mizumo | 399/333 |
| 2011/0261102 | A1 | 10/2011 | Kurasawa et al. | |
| 2012/0189370 | A1 | 7/2012 | Barker et al. | |

FOREIGN PATENT DOCUMENTS

| | | |
|---|---|---|
| DE | 4030824 | 5/1991 |
| JP | 2003-237049 | 8/2003 |

OTHER PUBLICATIONS

European Search Report for European Patent Application No. 13189350.5 dated Jan. 22, 2014.

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus includes: an apparatus main body that has a transportation unit which transports a recording medium and a liquid droplet ejection head which ejects an ink onto the recording medium; a curing unit that has a curing heater which heats and cures the ink on the recording medium; and a support mechanism that connects the apparatus main body and the curing unit, and displaceably supports the curing unit to be in an unfolded state and to be in a folded state where a depth which is the total length of the apparatus main body and the curing unit is shorter than that in the unfolded state in a direction orthogonal to the longitudinal direction of the apparatus main body.

13 Claims, 8 Drawing Sheets

PRINTING APPARATUS

BACKGROUND

1. Technical Field

The present invention relates to a printing apparatus.

2. Related Art

In the related art, when printing a relatively large-sized poster, a printing apparatus in which a recording medium that is wound around in a roll shape is drawn and an ink is imparted to print on the drawn recording medium has been employed (for example, see JP-A-2003-237049). The printing apparatus described in JP-A-2003-237049 includes a transporting mechanism that draws and transports the recording medium which is wound around in a roll shape, includes a head (print head) that applies an ink onto the transported recording medium, includes a heating mechanism (heating unit) that heats and dries the ink on the recording medium, and includes a casing (case) that collectively accommodates the aforementioned mechanisms.

When carrying the printing apparatus having the above-described configuration, for example, into an office that is a room in a building, there is a case where a door of the office is not large enough to allow the printing apparatus to pass through. In this case, since the printing apparatus cannot be carried in, the printing apparatus is disassembled to be reduced in size as small as possible, thereby allowing it to be carried in. Then, after being carried in, the printing apparatus is reassembled.

Likewise, in the printing apparatus described in JP-A-2003-237049, when performing carry-in work (similar in carry-out work), disassembling work and assembling work of the printing apparatus are accompanied. As a result, there has been a problem that the carry-in work is troublesome.

SUMMARY

An advantage of some aspects of the invention is to provide a printing apparatus that is advantageous when miniaturized, and can be easily carried in and out.

The above-mentioned advantage can be achieved by some aspects of the invention described below.

According to an aspect of the invention, there is provided a printing apparatus including: an apparatus main body that has a transportation unit which transports a recording medium and a liquid droplet ejection head which ejects an ink onto the recording medium; a curing unit that has a curing heater which heats and cures the ink on the recording medium; and a support mechanism connects the apparatus main body and the curing unit, and displaceably supports the curing unit to be in an unfolded state and to be in a folded state where a depth, which is the total length of the apparatus main body and the curing unit, is shorter than that in the unfolded state in a direction orthogonal to the longitudinal direction of the apparatus main body.

In this case, in a state where the curing unit is displaced into the folded state and a state where the curing unit is displaced into the unfolded state, the printing apparatus changes in size, particularly in depth in its entirety. Then, the entire size of the printing apparatus in the former state becomes the smallest, thereby being in a configuration that is advantageous when miniaturized. In addition, when the printing apparatus is carried in and out, the curing unit is displaced into the folded state. Accordingly, it is possible to easily perform the carry-in and carry-out thereof.

In the printing apparatus according to the aspect of the invention, it is preferable that the apparatus main body be long-shaped; and the depth, which is the total length of the apparatus main body and the curing unit in the direction orthogonal to the longitudinal direction of the apparatus main body, be less than 750 mm when the curing unit is in the folded state, and 900 mm or greater when the curing unit is in the unfolded state.

In this case, the width of an ordinary door is approximately 750 mm, even a relatively small door. When the printing apparatus is carried in and out, the printing apparatus needs to pass through the small door having the width of approximately 750 mm. In this case, if the curing unit is located to be in the folded state, the depth of the printing apparatus becomes smaller than 750 mm. Therefore, the printing apparatus can easily and reliably pass through the door.

In the printing apparatus according to the aspect of the invention, it is preferable that the support mechanism be configured to rotatably support the curing unit with respect to the apparatus main body.

In this case, when the curing unit is displaced between the folded state and the unfolded state, the operation of the displacement can be easily performed compared to a case when the displacement is performed by moving (sliding) along a horizontal direction, for example.

In the printing apparatus according to the aspect of the invention, it is preferable that the apparatus main body be long-shaped, and the support mechanism have a first member that is fixed to at least one of an end side and the other end side of the apparatus main body and connected to the curing unit, a second plate member that is provided to overlap the first plate member and connected to the curing unit, and a connection section connecting the first plate member and the second plate member.

In this case, the curing unit can be reliably and rotatably supported with respect to the apparatus main body, and the rotation thereof can be smoothly performed.

In the printing apparatus according to the aspect of the invention, it is preferable that the connection section have a cam groove that is provided in one plate member of the first plate member and the second plate member, and a follower section that is provided in the other plate member and inserted into the cam groove.

In this case, the curing unit smoothly rotates with respect to the apparatus main body. Therefore, the printing apparatus can be in a state to be easily carried in and out.

In the printing apparatus according to the aspect of the invention, it is preferable that the cam groove have a first groove in which the follower section is located in the folded state; and a second groove which communicates with the first groove and extends toward a different direction from the first groove, and in which the follower section is located in the unfolded state.

In this case, the curing unit smoothly rotates with respect to the apparatus main body. Therefore, the printing apparatus can be in a state to be easily carried in and out.

In the printing apparatus according to the aspect of the invention, it is preferable that the other plate member have an operation lever that is operated in order to assist a movement of the follower section when the follower section moves from the second groove to the first groove.

In this case, the movement of the follower section from the second groove to the first groove is reliably performed, and an inadvertent movement is also prevented. Accordingly, the printing apparatus is excellent in safety.

In the printing apparatus according to the aspect of the invention, it is preferable that the support mechanism have a biasing member by which the follower section is biased toward the apparatus main body side.

In this case, the follower section can be reliably prevented from being inadvertently moved within the cam groove. Accordingly, it is possible to reliably maintain the state of the curing unit located in the folded state or the state of the curing unit in the unfolded state.

In the printing apparatus according to the aspect of the invention, it is preferable that the curing unit be fastened to the first plate member and the second plate member via a bolt when the curing unit is in the unfolded state.

In this case, the state of the curing unit located in the unfolded state can be reliably maintained. Accordingly, while the printing apparatus is in the middle of printing in the aforementioned state, it is possible to reliably prevent the curing unit from being inadvertently displaced into the folded state.

In the printing apparatus according to the aspect of the invention, it is preferable that the support mechanism be configured to generate a notification sound that notifies completion of a displacement when the curing unit is displaced from the folded state to the unfolded state.

In this case, it is possible to check the curing unit which is displaced into the unfolded state by hearing the notification sound.

In the printing apparatus according to the aspect of the invention, it is preferable that the curing unit have an embellished surface on which coating is applied, and the embellished surface faces a front side of the printing apparatus at any position of the folded state and the unfolded state.

In this case, regardless of the curing unit being in either the folded state or in the unfolded state, the embellished surface can be visually recognized at the front. Accordingly, the printing apparatus is excellent in esthetics.

In the printing apparatus according to the aspect of the invention, it is preferable that the curing unit be carried in and out in a displaced state within the folded state, and the curing unit be in use in the displaced state of the unfolded state.

In this case, when the printing apparatus is carried in and out, the curing unit is displaced into the folded state to allow the printing apparatus to be reduced in size as small as possible, particularly in depth. Accordingly, it is possible to easily perform the carry-in and the carry-out thereof.

In the printing apparatus according to the aspect of the invention, it is preferable that the curing heater be arranged at a side of the recording medium onto which the ink is imparted, has a tube that is configured of a metal material, and has a heating unit that is inserted into the tube and generates heat by electrification.

In this case, it is possible to efficiently heat the ink onto the recording medium. Accordingly, the ink is promoted in curing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus of some aspects of the invention will be described in detail based on suitable embodiments illustrated in accompanying drawings.

Figure 1:
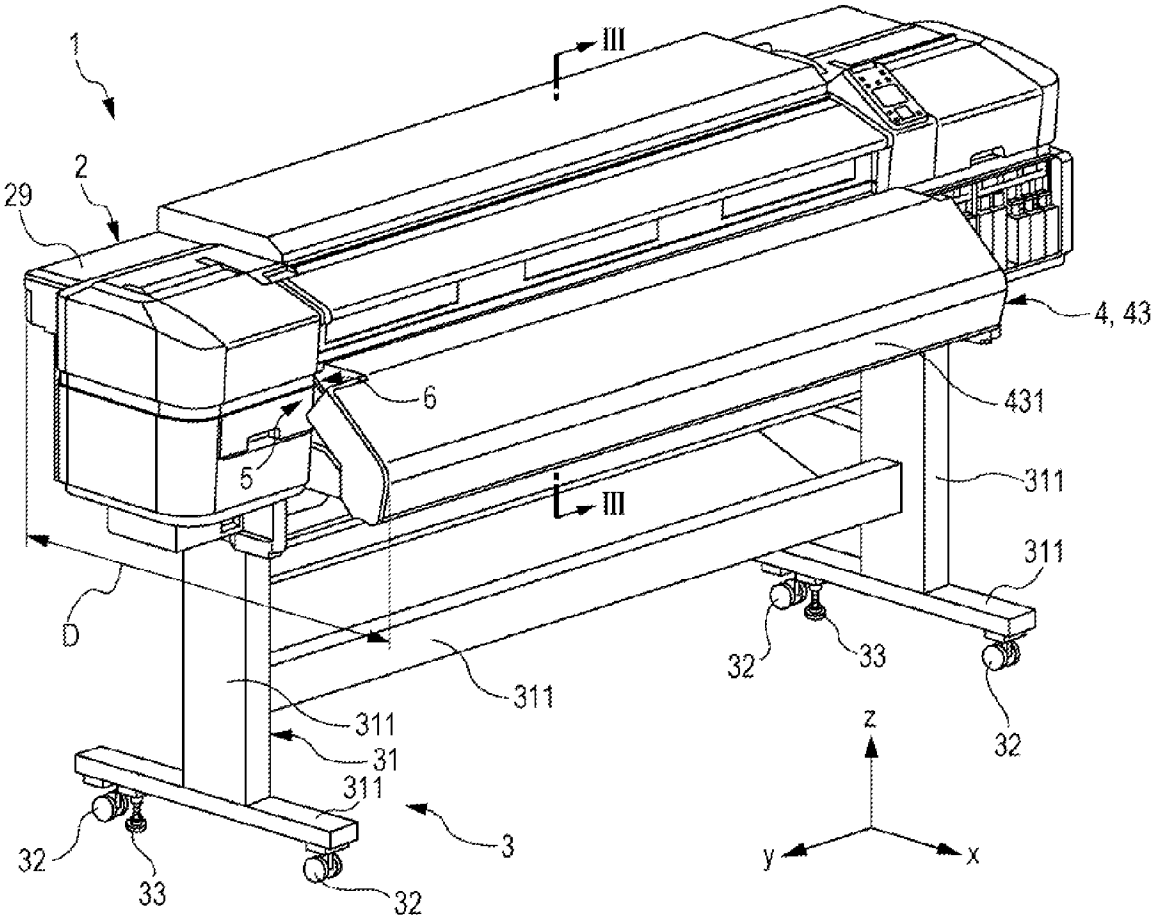
FIG. 1 is a perspective view illustrating a state of a printing apparatus of an aspect of the invention in use.
Figure 2:
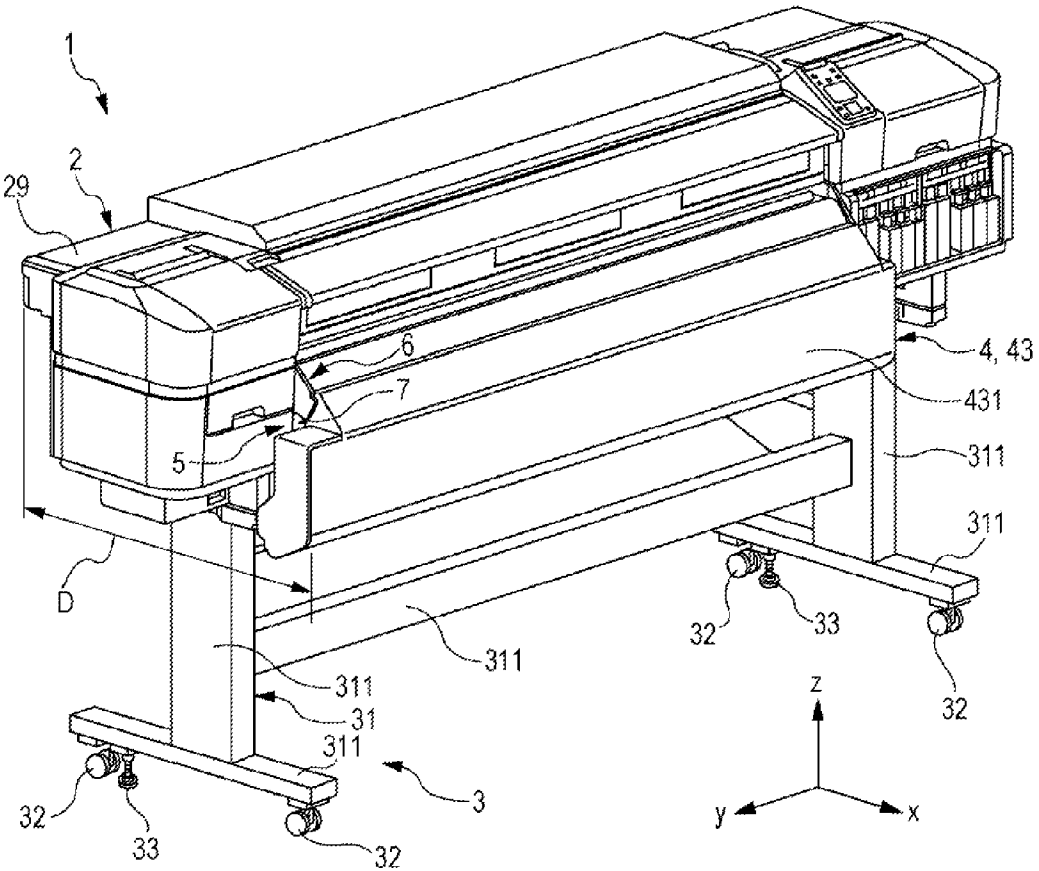
FIG. 2 is a perspective view illustrating a transportation state of the printing apparatus of the aspect of the invention.
Figure 3:
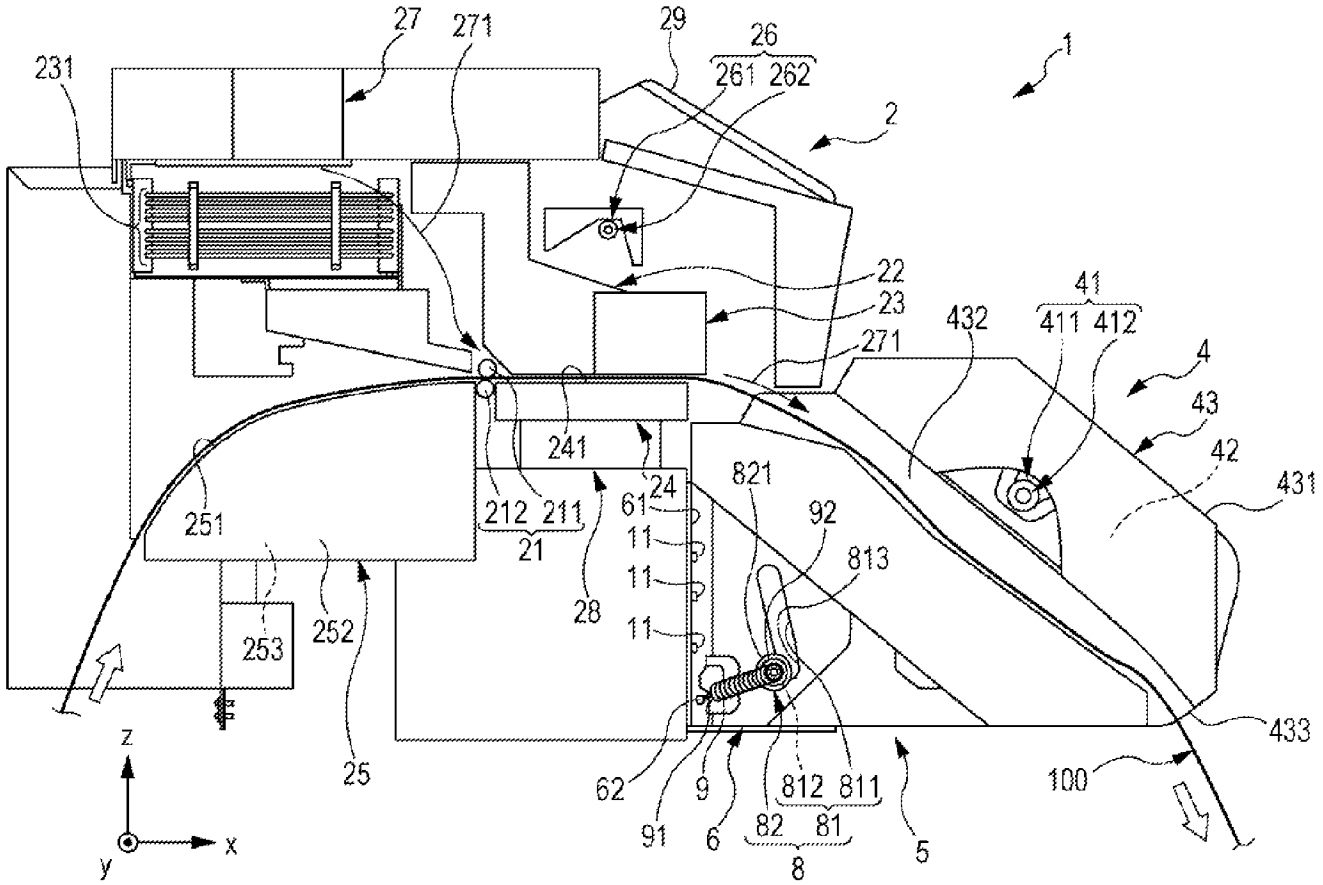
FIG. 3 is a cross-sectional view (schematic cross-sectional view) taken along the line III-III in FIG. 1.

FIG. 1 is a perspective view illustrating a state of the printing apparatus of an aspect of the invention in use, FIG. 2 is a perspective view illustrating a transportation state of the printing apparatus of the aspect of the invention. FIG. 3 is a cross-sectional view (schematic cross-sectional) taken along the line III-III in FIG. 1, and FIGS. 4 to 8 are side views respectively illustrating an operation process of the printing apparatus of the aspect of the invention from the state illustrated in FIG. 1 to the state illustrated in FIG. 2 in that order. Furthermore, hereinafter, for convenience of description, an x-axis, a y-axis and a z-axis are illustrated as three axes orthogonal to one another in FIGS. 1 to 8. The x-axis is an axis along one direction (width (depth) direction of the printing apparatus) in the horizontal direction, the y-axis is the horizontal direction an axis along a direction (longitudinal direction of the printing apparatus) perpendicular to the x-axis, and the z-axis is an axis along a vertical direction (up-and-down direction). In addition, a tip side of each illustrated arrow denotes the "positive side (plus side)", and a base end side thereof denotes the "negative side (minus side)". In addition, an upper side in FIGS. 1 to 8 is referred to as "up (upper part)", and a lower side is referred to as "down (lower part)".

As illustrated in FIGS. 1 to 3, a printing apparatus 1 includes an apparatus main body 2, a leg section (stand) 3, a curing unit 4, and a support mechanism 5. The printing apparatus 1 is an ink jet-type apparatus that imparts an ink onto a recording medium 100 to perform color printing. Hereinafter, the configuration of each component will be described.

First, the ink and the recording medium 100 will be described.

The ink employed in printing is a so-called "latex ink" and loaded in the printing apparatus 1 as an ink set (cartridge). The ink set includes a first ink and a second ink which have a predetermined composition, and satisfies either predetermined condition (A) or (B) described below.

The first ink contains a colorant, resin particles, a first humectant and a non-proton type polar solvent.

The second ink contains the colorant in an amount that exceeds the content of the colorant included in the first ink, the resin particles in an amount less than the content of the resin particles included in the first ink, a second humectant, and the non-proton type polar solvent.

Meanwhile, both the first ink and the second ink do not substantially contain alkyl-polyol having a boiling point of 280° C. or higher. Accordingly, it is possible to reduce the load during a drying process.

Here, the above-mentioned term "not substantially contain" denotes, for example, not to contain 1.0 mass % or more, preferably not to contain 0.5 mass % or more, more preferably not to contain 0.1 mass % or more, still more preferably not to contain 0.05 mass % or more, yet more preferably not to contain 0.01 mass % or more, and most preferably not to contain 0.001 mass % or more with respect to the total mass (100 mass %) of the ink.

Furthermore, it is preferable that the ink set be configured of the first ink and the second ink. However, an ink that is different from the above-mentioned inks may be further included, in addition to the first ink and the second ink. In addition to the first ink and the second ink, if an ink which is different from the aforementioned inks is further included, the further included ink may contain the alkyl-polyol having a boiling point of 280° C. or higher.

Hereinafter, an additive (component) that is included or may be included in each ink (ink composition) configuring the ink set will be described.

In the following, if the first ink and the second ink that configure the ink set, and an ink that is different from the above-mentioned inks are further included, the further included ink may be also collectively referred to as an "ink".

Furthermore, unless particularly stated, each component contained in the first ink and each component contained in the second ink are respectively and independently selected in terms of type, physical properties thereof, content, and the like. In addition, not only in a case where both the first ink and the second ink that are included in one ink set consist of one type alone, but also in a case where the first ink is present in plural types and in a case where the second ink is present in plural types, similarly as above, type, physical properties thereof, content, and the like of each component included in the respective inks are respectively and independently selected.

Moreover, in a case where the first ink included in one ink set is present in plural types, the "content of the first ink" denotes an average of the contents in the respective first inks. Furthermore, the same denoting can be applied to a case where the second ink is present in the plurality of types.

Humectant

Both the first ink and the second ink included in the ink set contain the humectant. Here, the "first humectant" in the specification denotes the humectant included in the first ink, and the "second humectant" in the specification denotes the humectant included in the second ink. The first humectant and the second humectant are correlative to each other in that the aforementioned two humectants satisfy either condition of (A) or (B) described below.

Hereinafter, each condition in (A) and (B) will be described.

First, the condition in (A) will be described. In (A), the first humectant is, (a1) a 1,2-alkanediol and non 1,2-alkanediol solvent, or (a2) a non 1,2-alkanediol solvent. In addition, the boiling point of the non 1,2-alkanediol solvent between the first humectants is within a range from 200° C. to 260° C. That is, regardless of whether to include the 1,2-alkanediol solvent or not, the first humectant essentially includes the non 1,2-alkanediol solvent having a predetermined boiling point.

If the boiling point of the first humectant is 200° C. or higher, the first humectant becomes excellent in the intermittent printing property. Meanwhile, if the boiling point of the first humectant is 260° C. or lower, since glycerin and the like are not added thereto, the quick-drying property becomes favorable such that a recorded matter is excellent in friction resistance.

The non 1,2-alkanediol solvent which is the first humectant is not particularly limited, as long as the boiling point is within a range from 200° C. to 260° C. or lower. However, for example, glycol ethers and 1,α-alkanediol (however, excluding α=2) can be exemplified.

The glycol ethers are not limited to the following. However, for example, polyalkylene glycols such as diethylene glycol, dipropylene glycol, and dibutylene glycol can be exemplified. The 1,α-alkanediol (however, excluding α=2) is not limited to the following. However, for example, 1,4-butanediol, 1,5-pentanediol, 1,6-hexanediol, and 1,7-heptanediol can be exemplified. As alkylene glycol monoether included in the polyalkylene glycols; ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, triethylene glycol monomethyl ether, triethylene glycol monoethyl ether, triethylene glycol monobutyl ether, tetraethylene glycol monomethyl ether, tetraethylene glycol monoethyl ether, propylene glycol monomethyl ether, propylene glycol monoethyl ether, dipropylene glycol monomethyl ether, and dipropylene glycol monoethyl ether can be exemplified. As alkylene glycol diether included in the polyalkylene glycols; and ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether can be exemplified. It is preferable to use the polyalkylene glycols among the glycol ethers to obtain an excellent moisture retaining property therein.

In order that the appropriate moisture retaining property can be imparted thereto, it is preferable that one or more types selected from the glycol ethers and 1,α-alkanediol (however, excluding α=2) be used among thereabove.

In a case where the first humectant is (a1) the 1,2-alkanediol and non 1,2-alkanediol solvent, in the first ink, it is preferable that the mass ratio of the content of the total first humectant and the content of the below-described non-proton type polar solvent ("content of the total first humectant": "content of the non-proton type polar solvent") be 0.6 to 2.6. If the mass ratio is within the above range, the first ink becomes excellent in adhesion.

In addition, in (A) described above, the condition in which the boiling point of the first humectant exceeds the boiling point of the second humectant is also satisfied. Furthermore, the "boiling point of the first humectant" in the specification denotes an average of the boiling points of two or more types of solvents in a case where the first humectant is configured of two types or more, and the same denoting can be applied to the "boiling point of the second humectant".

On the assumption that the conditions are satisfied, the second humectant is, (a3) the 1,2-alkanediol and non 1,2-alkanediol solvent, or (a4) the non 1,2-alkanediol solvent. In addition, it is preferable that the boiling point of the non 1,2-alkanediol solvent between the second humectants be within a range from 160° C. to 240° C. That is, the second humectant may be the 1,2-alkanediol. However, regardless of whether to include the 1,2-alkanediol solvent or not, it is preferable that the second humectant include the non 1,2-alkanediol solvent having a predetermined boiling point.

If the boiling point of the second humectant is 160° C. or higher, the second humectant becomes excellent in the intermittent printing property. Meanwhile, if the boiling point of the second humectant is 240° C. or lower, a drying load can be effectively reduced.

The non 1,2-alkanediol solvent which is the second humectant is not particularly limited, as long as the boiling point is within a range from 160° C. to 240° C., and lower than that of the first humectant. However, the glycol ethers can be preferably exemplified for having excellent drying property.

Next, the condition in (B) will be described. Both the first humectant and the second humectant are the dipropylene glycol. In addition, the content of the dipropylene glycol included in the first ink exceeds the content of the dipropylene glycol included in the second ink.

It is preferable that the content of the dipropylene glycol included in the first ink be within a range from 3 mass % to 30 mass % with respect to the total mass (100 mass %) of the first ink, and it is more preferable to be within a range from 5 mass % to 15 mass %. Meanwhile, it is preferable that the content of the dipropylene glycol included in the second ink be within a range from 3 mass % to 30 mass %, and it is more preferable to be within a range from 5 mass % to 15 mass %. If each content of the dipropylene glycol included in the first ink and the second ink is within the above range, the drying load can be effectively reduced.

Moreover, if the ink set further includes an ink which is different from the first ink and the second ink, the further included ink may contain the above-described humectants.

Colorant

The first ink and the second ink included in the ink set contain the colorant. The colorant is selected from pigments and dyes.

1. Pigment

The pigment of the colorant has a property of which is not only insoluble or hardly soluble in water but also difficult to be discolored with respect to light, gas and the like. Accordingly, a recorded matter recorded by the ink employing the pigment becomes favorable in water resistance, gas resistance, light resistance and preservation stability.

Either an inorganic pigment or an organic pigment can be used for the pigment. Since the color developing property thereof is favorable and precipitation does not easily occur when dispersed due to the small specific gravity, at least either carbon black belonging to the inorganic pigment or the organic pigment is preferable as the pigment.

The inorganic pigment is not particularly limited. However, for example, carbon black, iron oxide and titanium oxide can be exemplified.

The carbon black is not particularly limited. However, for example, furnace black, lamp black, acetylene black and channel black (C.I. Pigment Black 7) can be exemplified. In addition, as the commercial products for the carbon black, for example; No. 2300, 900, MCF 88, No. 20B, No. 33, No. 40, No. 45, NO. 52, MA7, MA8, MA100, and No. 2200B (hereinbefore, all product names, manufactured by Mitsubishi Chemical Corporation); Color Black FW1, FW2, FW2V, FW18, FW200, S150, S160, S170, Printex 35, U, V, 140U, Special Black 6, 5, 4A, 4, and 250 (hereinbefore, all product names, manufactured by Degussa AG); Conductex SC, Raven 1255, 5750, 5250, 5000, 3500, 1255, and 700 (hereinbefore, all product names, manufactured by Columbian Carbon Japan Ltd.); and Regal 400R, 330R, 660R, Mogul L, Monarch 700, 800, 880, 900, 1000, 1100, 1300, 1400, and Elftex 12 (hereinbefore, all product names, manufactured by Cabot Corporation) can be exemplified.

The organic pigment is not particularly limited. However, for example, quinacridone-based pigment, quinacridone-quinone-based pigment, dioxazine-based pigment, phthalocyanine-based pigment, anthrapyrimidine-based pigment, anthanthrone-based pigment, indanthrone-based pigment, flavanthrone-based pigment, perylene-based pigment, diketopyrrolopyrrole-based pigment, perinone-based pigment, quinophthalone-based pigment, anthraquinone-based pigment, thioindigo-based pigment, benzimidazolone-based pigment, isoindolinone-based pigment, azomethine-based pigment and azo-based pigment can be exemplified. As the specific examples for the organic pigment, the following can be exemplified.

As the pigment to be used for a cyan ink, C.I. Pigment Blue 1, 2, 3, 15, 15:1, 15:2, 15:3, 15:4, 15:6, 15:34, 16, 18, 22, 60, 65, and 66; and C.I. Batblue 4, and 60 can be exemplified.

As the pigment to be used for a magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264; and C.I. Pigment Violet 19, 23, 32, 33, 36, 38, 43, and 50 can be exemplified.

As the pigment to be used for a yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 can be exemplified.

Furthermore, as the pigment to be employed for other colors of the inks such as green ink or orange ink in addition to the above-mentioned colors, known materials in the related art can be exemplified.

The pigment may be employed in one type alone, or may be employed in a combination of two types or more.

2. Dye

The dye of the colorants is not limited to the following. However, for example, acid dye, direct dye, reactive dye and basic dye can be exemplified. As the specific examples for the dyes, C.I. Acid Yellow 17, 23, 42, 44, 79, and 142; C.I. Acid Red 52, 80, 82, 249, 254, and 289; C.I. Acid Blue 9, 45, and 249; C.I. Acid Black 1, 2, 24, and 94; C.I. Food Black 1, and 2; C.I. Direct Yellow 1, 12, 24, 33, 50, 55, 58, 86, 132, 142, 144, and 173; C.I. Direct Red 1, 4, 9, 80, 81, 225, and 227; C.I. Direct Blue 1, 2, 15, 71, 86, 87, 98, 165, 199, and 202; C.I. Direct Black 19, 38, 51, 71, 154, 168, 171, and 195; C.I. Reactive Red 14, 32, 55, 79, and 249; and C.I. Reactive Black 3, 4, and 35 can be exemplified.

The dye may be employed in one type alone, or may be employed in a combination of two types or more.

The content of the colorant included in the second ink is greater than the content of the colorant included in the first ink. The first ink and the second ink can be respectively referred to as the light ink and the dark ink from a viewpoint of an amount of the colorant.

It is preferable that the content of the colorant included in the second ink be 1 mass % to 7 mass % with respect to the total mass (100 mass %) of the second ink. In addition, it is preferable that the content of the colorant included in the first ink be 0.1 mass % to 2 mass % with respect to the total mass (100 mass %) of the first ink.

Moreover, if the ink set further includes an ink which is different from the first ink and the second ink, the further included ink may contain the above-described colorant.

Resin Particle

The first ink and the second ink included in the ink set contain the resin particles. Since the first ink and the second ink contain the resin particles, a recorded matter is excellent in friction resistance.

In addition, the content of the resin particles included in the second ink is less than the content of the resin particles included in the first ink. Accordingly, it is possible to make the viscosity of each ink configuring the ink set uniform. The content of each of the resin particles included in the first ink and the second ink will be described below.

The resin particle is not limited to the following. However, for example, a wax such as a binder resin, a paraffin wax and polyolefin wax can be exemplified.

1. Binder Resin

When the recording medium 100 is heated for ink jet recording, the binder resin forms resin coating to cause the ink to be sufficiently fixed onto the recording medium 100, thereby exhibiting effectiveness to make a recorded matter favorable in friction resistance. Therefore, it is preferable that the binder resin be a thermoplastic resin. According to the above-described effect, a recorded matter recorded with the ink containing the binder resin is more excellent in friction resistance on the recording medium 100 which is non-ink absorbable and low ink absorbable.

In addition, the binder resin is contained in the ink in an emulsion state. If the binder resin is contained in the ink in the emulsion state, the viscosity of the ink is easily adjusted within an appropriate range in an ink jet recording method, while being excellent in preservation stability and ejection stability of the ink.

Furthermore, the "ejection stability" in the specification denotes a property with which a nozzle is clog-free such that stable ink droplets are ejected from the nozzle all the time.

The binder resin is not limited to the following. However, for example; a homopolymer or a copolymer of (meth)acrylic acid, (meth)acrylic acid ester, acrylonitrile, cyanoacrylate, acrylamide, olefin, styrene, vinyl acetate, vinyl chloride, vinyl alcohol, vinyl ethers, vinyl pyrrolidone, vinyl pyridine, vinyl carbazole, vinyl imidazole, and vinylidene chloride; a fluorine resin; and a natural resin can be exemplified. Among the above, at least either a (meth)acrylic resin or a styrene-(meth)acrylic acid copolymer resin is preferable, at least either an acrylic resin or a styrene-acrylic acid copolymer resin is more preferable, and a styrene-acrylic acid copolymer resin is still more preferable. Furthermore, the copolymer may be any one of a random copolymer, a block copolymer, an alternating copolymer and a graft copolymer.

Furthermore, in the specification, "(meth)acrylic" denotes at least either acryl or methacryl corresponding thereto.

As the binder resin, a material which can be obtained by known materials and manufacturing methods may be employed, or commercial products may be employed. The commercial products are not limited to the following. However, for example; Microgel E-1002, and Microgel E-5002 (hereinbefore, product names, manufactured by Nippon Paint Co., Ltd.); Bon Coat 4001, and Bon Coat 5454 (hereinbefore, product names, manufactured by DIC Corporation); SAE 1014 (product name, manufactured by Zeon Corporation); Saivinol SK-200 (product name, manufactured by Saiden Chemical Industry Co., Ltd.); and Joncryl 7100, Joncryl 390, Joncryl 711, Joncryl 511, Joncryl 7001, Joncryl 632, Joncryl 741, Joncryl 450, Joncryl 840, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, and Joncryl 7610 (hereinbefore, product names, manufactured by BASF) can be exemplified.

The binder resin is not particularly limited. However, the binder resin can be obtained, for example, by the preparation methods described below. Otherwise, a plurality of methods may be combined if necessary. As the preparation method; a method in which a polymerization catalyst (polymerization initiator) and dispersant are mixed in a monomer with components configuring a desired resin for polymerization (emulsion polymerization); a method in which a resin having a hydrophilic moiety is dissolved in a water-soluble organic solvent to obtain a solution that is to be mixed into water, and then, the water-soluble organic solvent is eliminated by distillation or the like; and a method in which a resin is dissolved in a water-insoluble organic solvent to obtain a solution that is to be mixed with the dispersant in an aqueous solution.

The dispersant that can be used for dispersing the binder resin in an emulsion state is not particularly limited. However, for example; an anionic surfactant such as dodecyl benzene sulfonic acid sodium salt, sodium lauryl phosphate salt, and polyoxyethylene alkyl ether sulfate ammonium salt; and a nonionic surfactant such as polyoxyethylene alkyl ethers, polyoxyethylene alkyl esters, polyoxyethylene sorbitan fatty acid esters, and polyoxyethylene alkyl phenyl ether can be exemplified. The dispersants may be employed in one type alone, or may be employed in combination of two types or more.

It is preferable that the average particle diameter of the binder resin be within a range from 5 nm to 400 nm, and it is more preferable to be within a range from 20 nm to 300 nm, in order to have favorable preservation stability and ejection stability of the ink.

Here, the average particle diameter in the specification indicates the measured value by a dynamic light scattering method.

It is preferable that the content (converted into solid content) of the binder resin which may be included in each ink be within a range from 0.5 mass % to 5 mass % with respect to the total mass (100 mass %) of the ink, and it is more preferable to be within a range from 0.5 mass % to 1.5 mass %. If the content is within the above range, the ink becomes more excellent in friction resistance.

2. Paraffin Wax

If the ink in the embodiment contains paraffin wax, slip performance is imparted to a recorded matter. Accordingly, the ink is more excellent in friction resistance. Furthermore, since the paraffin wax is water-repellent, the recorded matter can be favorable to water resistance.

The "paraffin wax" in the specification denotes a so-called petroleum-based wax, and denotes a hydrocarbon mixture with the approximate weight-average molecular weight of 300 to 500 including a small amount of isoparaffin, while the main component thereof is linear paraffin hydrocarbon (normal paraffin) with an approximate carbon number of 20 to 30.

If the ink in the embodiment contains the paraffin wax in an emulsion state, viscosity of the ink is easily adjusted within an appropriate range in the ink jet recording method, while being able to achieve excellent preservation stability and ejection stability of the ink.

It is preferable that the melting point of the paraffin wax be 110° C. or lower in order to further secure the coating of a recorded matter and further make the recorded matter be favorable in friction resistance. Meanwhile, it is preferable that the lower limit of the melting point of the paraffin wax be 60° C. or higher in order to prevent the dried recorded surface from being sticky. Furthermore, it is more preferable that the melting point be 70° C. to 95° C. in order to cause the ink to be more favorable in ejection stability.

It is preferable that the average particle diameter of the paraffin wax be within a range from 5 nm to 400 nm, and it is more preferable to be within a range from 50 nm to 200 nm in order to achieve still more favorable preservation stability and ejection stability of the ink in a stable emulsion state. As the paraffin wax, commercial products may be utilized in its integrity. The commercial products are not limited to the following. However, for example, Aquacer 537 and Aquacer 539 (hereinbefore, product names, manufactured by BYK-Chemie GmbH) can be exemplified.

It is preferable that the content (converted into solid content) of the paraffin wax which may be included in each ink be within a range from 0 mass % to 1.5 mass % with respect to the total mass (100 mass %) of the ink, and it is more preferable to be within a range from 0.25 mass % to 0.75 mass %.

3. Polyolefin Wax

If the ink in the embodiment contains polyolefin wax, it is possible to obtain a recorded matter that is more excellent in friction resistance of a recorded matter. The polyolefin wax is not limited to the following, for example, polyethylene wax and polypropylene wax can be exemplified, and polypropylene is preferable therebetween.

As an exemplification of a manufacturing method of the polyethylene wax, the polyethylene wax is produced by polymerizing ethylene to be manufactured or causing the polyethylene for general molding to have a low molecular weight through thermal decomposition so as to be manufactured. Then, a carboxyl group and a hydroxyl group are added to the oxidized polyethylene wax to be further emulsified using a surfactant. Thereafter, polyethylene wax can be obtained in a form of an aqueous emulsion having excellent stability.

As the polyolefin wax, commercial products may be utilized in its integrity. The commercial products of the polyethylene wax thereamong are not limited to the following, for example, Nopcoat PEM 17 (product name, manufactured by Sannopco Limited), Chemipearl W4005 (product name, manufactured by Mitsui Chemicals Inc.), and Aquacer 515 and Aquacer 593 (hereinbefore, product names, manufactured by BYK-Chemie GmbH) can be exemplified.

It is preferable that the average particle diameter of the polyolefin wax be within a range from 5 nm to 400 nm, and it is more preferable to be within a range from 50 nm to 200 nm, in order to achieve still more favorable preservation stability and ejection stability of the ink.

It is preferable that the content (converted into solid content) of the polyolefin wax which may be included in each ink be within a range from 0 mass % to 1.5 mass % with respect to the total mass (100 mass %) of the ink, and it is more preferable to be within a range from 0.25 mass % to 0.75 mass %.

Since a recorded matter becomes more excellent in friction resistance, it is preferable that the resin particle be at least either the polyolefin wax or paraffin wax among the materials hitherto described.

Furthermore, each ink may contain other waxes as the resin particles in addition to the polyolefin wax and the paraffin wax. The wax has a function to impart slip performance onto a front surface of a formed recorded matter to be more favorable in friction resistance. It is preferable that the wax be contained in the ink in an emulsion state. If the wax is present in the ink in the emulsion state, viscosity of the ink is easily adjusted within an appropriate range in the ink jet recording method, while being more excellent in preservation stability and ejection stability of the ink.

Moreover, if the ink set further includes an ink which is different from the first ink and the second ink, the further included ink may contain the above-described resin particle.

Non-Proton Type Polar Solvent

The first ink and the second ink included in the ink set contain a non-proton type polar solvent. The first ink and the second ink contain the non-proton type polar solvent to dissolve the above-mentioned resin particles included the inks, thereby effectively preventing the clogging in the nozzle when performing the ink jet recording.

The non-proton type polar solvents contained in the first ink and the second ink may have the same component as each other.

The non-proton type polar solvent is not limited to following. However, it is preferable to include one type or more selected from a group consisting of pyrrolidones, lactones, sulfoxides, imidazolidinones, sulfolanes, urea derivatives, dialkyl amides, cyclic ethers and amide ethers.

As the specific examples for the pyrrolidones, 2-pyrrolidone, N-methyl-2-pyrrolidone, and N-ethyl-2-pyrrolidone can be exemplified. As the specific examples for the lactones, γ-butyrolactone, γ-valerolactone, and ϵ-caprolactone can be exemplified. As the specific examples for the sulfoxides, dimethyl sulfoxide, and tetramethylene sulfoxide can be exemplified. As the specific example for the imidazolidinones, 1,3-dimethyl-2-imidazolidinone can be exemplified. As the specific examples for the sulfolanes, sulfolane, and dimethyl sulfolane can be exemplified. As the specific examples for the urea derivatives, dimethyl urea, and 1,1,3,3-tetramethyl urea can be exemplified. As the specific examples for the dialkyl amides, dimethylformamide, and dimethylacetamide can be exemplified. As the specific examples for the cyclic ethers, 1,4-dioxane, and tetrahydrofuran can be exemplified.

In addition, a solvent represented by following Chem. 1 corresponds to the amide ethers.

(1)

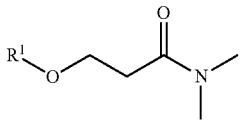

In Chem. 1, it is suitable for $R^1$ to be an alkyl group with the carbon number of 1 to 4. An "alkyl group with the carbon number of 1 to 4" may be a linear or branched alkyl group such that it is possible to be, for example, a methyl group, an ethyl group, an n-propyl group, an iso-propyl group, an n-butyl group, an iso-butyl group, a sec-butyl group and a tert-butyl group. A solvent that is represented by Chem. 1, in which $R^1$ is the alkyl group with the carbon number of 1 to 4, can impart proper pseudoplasticity to an ink composition. Accordingly, favorable ejection stability of the ink can be secured. In addition, since the solvent, represented by Chem. 1 in which $R^1$ is the alkyl group with the carbon number of 1 to 4, is particularly strong in a resin dissolving action, thereby being preferable.

It is preferable that HLB value of the solvent represented by Chem. 1 be within a range from 10.5 or more and 20.0 or less, and it is more preferable to be within a range from 12.0 or more and 18.5 or less. It is more suitable for the HLB value of the solvent represented by Chem. 1 to be within the above range, in terms of being able to impart proper pseudoplasticity to the ink, and interacting with the resin component.

Furthermore, the HLB value of the solvent represented by Chem. 1 is a value calculated by the following equation from the ratio of a non-polar value (I) and an organic value (O) (hereinafter, may be simply referred to as "I/O value") in an organic conceptual diagram.

$$HLB \text{ value}=(\text{non-polar value}(I)/\text{organic value}(O))\times 10$$

Specifically, the I/O value can be calculated based on each literature of "SYSTEMATIC ORGANIC QUALITATIVE ANALYSIS, MIXTURE" (Atsushi FUJITA, Kazamashobo, 1974), "CHEMISTRY IN THEORY OF DYEING" (Nobuhiko KUROKI, Makishoten, 1966), and "ORGANIC COMPOUND SEPARATION METHOD" (Hiroo INOUE, Shokabo, 1990).

In order to have excellent fixation property with respect to the recording medium 100, it is preferable that one type or more be selected from a group consisting of pyrrolidones, lactones, sulfoxides, and amide ethers among the above-mentioned non-proton type polar solvents.

It is preferable that the boiling point of the non-proton type polar solvent be within a range from 200° C. to 260° C.

A specific example of the non-proton type polar solvent is not limited to the following. However, 2-pyrrolidinone is suitably employed.

The non-proton type polar solvents respectively included in the first ink and the second ink may be employed in one type alone, or may be a combination of two types or more to be employed.

It is preferable that the content of the non-proton type polar solvent respectively included in the first ink and the second ink be within a range from 3 mass % to 30 mass % with respect to the total mass (100 mass %) of the ink, and it is more preferable to be within a range from 8 mass % to 20 mass %.

Moreover, if the ink set further includes an ink which is different from the first ink and the second ink, the further included ink may contain the above-described non-proton type polar solvent.

Surfactant

Each ink included in the ink set may contain the surfactant. Other surfactants are not limited to the following. However, for example, the nonionic surfactant can be exemplified. The nonionic surfactant acts to uniformly spread the ink on the recording medium 100. Therefore, if the ink jet recording is performed employing the ink including the nonionic surfactant, a high-definition image with little bleeding can be obtained. The nonionic surfactants are not limited to the following. However, for example; acetylene glycol-based surfactant; silicon-based surfactant; and polyoxyethylene alkyl ether-based, polyoxypropylene alkyl ether-based, polycyclic phenyl ether-based, sorbitan derivatives and fluorine-based surfactants can be exemplified.

The surfactant may be employed in one type alone, or may be a combination of two types or more to be employed.

The content of the surfactant which may be included in each ink is within a range from 1.5 mass % or less with respect to the total mass (100 mass %) of the ink.

Water

Each ink included in the ink set may contain water. Particularly, if the ink is a water-based ink, the water is a main medium in the ink so as to be a component evaporating and dispersing when the recording medium 100 is heated during the ink jet recording.

As the water, for example, water from which ion impurities are eliminated to the fullest such as pure water such as ion-exchanged water, ultrafiltration water, reverse osmosis water, distilled water, and ultrapure water can be exemplified. In addition, if water which is sterilized by irradiating ultra violet rays, adding hydrogen peroxide, or the like is employed, it is possible to prevent bacteria and fungi from occurring when preserving a pigment dispersing liquid and the ink employing the pigment dispersing liquid for a long period.

Other Components

Each ink included in the ink set may further contain an organic solvent other than the above-mentioned solvents, a pH regulator, an antiseptic, a fungicide, a rust inhibitor, a chelating agent, and the like in addition to the components described above.

The recording medium 100, to which the ink is imparted, has flexibility and is loaded to the printing apparatus 1 in a roll-shaped wound state. The recording medium 100 is suitable for the ink jet recording which employs not only an ink absorbent recording medium but also non-ink-absorbent and low-ink-absorbent recording media.

The ink absorbent recording medium 100 is not limited to the following. However, for example, paper for exclusive use for the ink jet recording such as plain paper, fine quality paper, and glossy paper can be exemplified. As the low-ink-absorbent recording medium 100, actual printing paper such as art paper, coated paper and matte paper can be exemplified. The non-ink-absorbent recording medium 100 is not limited to the following. However, for example; materials such as a plastic film, which is not surface-treated for the ink jet printing (that is, an ink absorbent layer is not formed thereon); materials in which a base material such as paper is coated with plastic and is adhered with a plastic film can be exemplified. The plastic is not particularly limited. However, for example, polyvinyl chloride, polyethylene terephthalate, polycarbonate, polystyrene, polyurethane, polyethylene and polypropylene can be exemplified.

Next, the printing apparatus 1 will be described. As described in the above, the printing apparatus 1 includes the apparatus main body 2, the leg section (stand) 3, the curing unit 4, and the support mechanism 5 (see FIGS. 1 and 2).

As illustrated in FIG. 3, the apparatus main body 2 has a transportation unit 21, a carriage 22, a liquid droplet ejection head 23, a platen 24, a preheater 25, a dry heater 26, a blower fan 27, a suction fan 28 and a casing (housing) 29.

The casing 29 is a boxlike member collectively accommodating the transportation unit 21, the carriage 22, the liquid droplet ejection head 23, the platen 24, the preheater 25, the dry heater 26, the blower fan 27, the suction fan 28 and the casing (housing) 29. In addition, the outer shape of the casing 29 (apparatus main body 2) is long-shaped along a y-axis direction.

The transportation unit 21 has rollers 211 and 212 which are arranged above and below so as to transport the recording medium 100. One roller between the rollers 211 and 212 is a driving roller connected to a motor via a speed reduction mechanism of a gear or the like, and the other roller is a driven roller. The driving roller rotates in a state where the recording medium 100 is clamped between the driving roller and the driven roller, thereby transporting, which means, being capable of sending out the recording medium 100 in concurrence with the driven roller. Hereinafter, a direction of transporting the recording medium 100 is referred to as a "transportation direction".

The preheater 25 heats the recording medium 100 in advance before printing is performed on the recording medium 100. The preheater 25 has a housing 252 having an abutting surface 251 on which a rear surface of the recording medium 100 abuts and a heating unit 253 accommodated inside the housing 252.

The abutting surface 251 is configured to form a curved surface which is curved in an arch shape. The recording medium 100 abuts on the abutting surface 251 during transportation by the transportation unit 21. At this moment, heat from the heating unit 253 is transferred to the recording medium 100 via the recording medium 100. Accordingly, it is possible to heat the abutting surface 251. Furthermore, it is preferable that the surface temperature of the recording medium 100 be, for example, within a range from 45 degrees to 55 degrees, and it is more preferable to be within a range from 60 degrees to 70 degrees when heating.

In addition, it is preferable that the curvature of the abutting surface 251 be gradually reduced toward a downstream side in the transportation direction, that is, the positive direction of the x-axis.

In addition, a configuration material of the housing 252 is not particularly limited. However, for example, aluminum, aluminum alloy or stainless steel can be employed.

The heating unit 253 generates heat by electrification, and is configured of, for example, a metal material having a relatively high electrical resistance such as a nichrome wire and the like.

The platen 24 is arranged at the downstream side in the transportation direction with respect to the preheater 25. The platen 24 is configured of a plate member so as to support the recording medium 100 from the lower side thereof when the ink is imparted to the recording medium 100. The platen 24 can be configured of, for example, the same material as the configuration material of the housing 252.

In addition, in the platen 24, numerous opening sections (not illustrated) that are open in an upper surface 241 are formed. It is preferable that the opening sections be arranged in a line along the surface direction of the platen 24.

Then, the suction fan 28 is arranged at the lower part of the platen 24. If the suction fan 28 is operated, that is, rotated, it is possible to suck the recording medium 100 on the platen 24 via each opening section 242 of the platen 24. Accordingly, the posture of the recording medium 100 can be stabilized when imparting the ink. Therefore, the ink is reliably imparted to the desired position on the recording medium 100.

Furthermore, the suction fan 28 is not particularly limited. However, for example, various kinds of fans such as a multi-blade fan (sirocco fan) and the like can be employed.

The carriage 22 supports the liquid droplet ejection head 23. The carriage 22 can reciprocate the entirety of the liquid droplet ejection head 23 along the y-axis direction, for example, by an operation of the movement mechanism that has the motor, a ball screw which is connected to the motor, and a linear guide which is arranged in parallel with the ball screw. Then, while the carriage 22 reciprocates, the ink is ejected from the liquid droplet ejection head 23 in a state where the recording medium 100 is transported in the positive direction of the x-axis. Accordingly, it is possible to print on the recording medium 100 with the ink.

The liquid droplet ejection head 23 is arranged at the upper part of the platen 24. The liquid droplet ejection head 23 has numerous nozzle ports (not illustrated) that are open toward the lower part, and can eject the ink as a liquid droplet from each nozzle port onto the recording medium 100.

In addition, each nozzle port of the liquid droplet ejection head 23 respectively communicates with the ink set (cartridge) via a tube 231. Accordingly, the ink can be supplied to each nozzle port.

The dry heater 26 is arranged to oppose the platen 24 via the liquid droplet ejection head 23. The dry heater 26 irradiates infrared rays toward the ink so as to facilitate drying of the ink during the imparting of the ink onto the recording medium 100.

The dry heater 26 has a tube 261 arranged along the y-axis direction, and the heating unit 262 arranged to be inserted through the inside of the tube 261.

It is preferable that the tube 261 be configured of the metal material, particularly configured of iron. Furthermore, it is preferable that the total length of the tube 261 along the y-axis direction be sufficiently longer than the width of the recording medium 100 along the y-axis direction. Accordingly, it is possible to reliably irradiate infrared rays toward the entirety of the ink on the recording medium 100 passing through the lower part of the tube 261 (dry heater 26).

The heating unit 262 generates heat by electrification, and is configured of, for example, electric heating wire such as a nichrome wire and the like. Then, the tube 261 is heated by the heating unit 262 generating heat, thereby irradiating infrared rays. Accordingly, it is possible to reliably evaporate moisture content in the ink, and thus, the ink can be dried. Furthermore, it is preferable that the heating temperature be, for example, within a range from 200 degrees to 400 degrees, and it is more preferable to be within a range from 250 degrees to 350 degrees, when the tube 261 is heated while printing.

Furthermore, in order to dry the ink on the recording medium 100, although heating from the rear surface side of the recording medium 100, that is, adopting a configuration in which the platen 24 functions as a heating plate can be considered, in this case, a film is generated in the ink due to the property of the ink, and thus, there is a possibility that the evaporation of the moisture content in the ink is hindered by the film. Accordingly, it is preferable to have a configuration that heats from the front surface side of the recording medium 100 as in the embodiment when drying the ink.

The blower fan 27 is arranged at the upstream side in the transportation direction on the upper portion of the apparatus main body 2. The blower fan 27 blows out wind 271 along the transportation direction. By the wind 271, it is possible to push out the vapor generated by heating the ink to the outside of the apparatus main body 2. Accordingly, for example, it is possible to prevent condensation from being generated onto the liquid droplet ejection head 23.

Furthermore, as the blower fan 27, similar as the suction fan 28, for example, various kinds of fans such as a multi-blade fan and the like can be employed.

The apparatus main body 2 having the above-described configuration is supported by the leg section 3 from the lower side thereof (see FIGS. 1 and 2). The leg section 3 is configured to include a frame section 31, four casters 32 and two adjuster feet (fixture) 33.

The frame section 31 is an assembly in which a plurality of rod-shaped members 311 are properly connected to each other to be fixed and assembled.

Each caster 32 is arranged and fixed at the lower portion of the frame section 31 so as to be separated from each other. Accordingly, it is possible to transport the printing apparatus 1.

In addition, each adjuster foot 33 is also fixed to the lower portion of the frame section 31. Each adjuster foot 33 is respectively arranged in the vicinity of two casters 32 located at the negative side of the x-axis among four casters 32. When regulating, that is, fixing the movement of the printing apparatus 1 after transporting the printing apparatus 1, it is possibly to perform the regulation by causing each adjuster foot 33 to respectively abut on the floor.

The curing unit 4 is arranged at the downstream side in the transportation direction with respect to the apparatus main body 2. As illustrated in FIGS. 3 to 8, the curing unit 4 has a curing heater 41, a cooling fan 42, and a casing (housing) 43.

The casing 43 is a boxlike member collectively accommodating the curing heater 41 and the cooling fan 42. In addition, an outer shape of the casing 43 (curing unit 4) is long-shaped along the y-axis direction, and the length thereof is shorter than that of the casing 29 (apparatus main body 2).

In addition, a passage 432 through which the recording medium 100 passes is provided in the casing 43. An end point of the passage 432 is a discharge port 433 from which the recording medium 100 is discharged.

In addition, the casing 43 has an embellished surface 431, on which the coating is applied, on the front surface side thereof. As described below, the curing unit 4 can obtain the unfolded state illustrated in FIG. 1 and the folded state illustrated in FIG. 2 by the support mechanism 5. Then, in any state, the embellished surface 431 faces the front side of the printing apparatus 1, that is, in the positive direction of the x-axis. Accordingly, the embellished surface 431 can be visually recognized at the front, and then, the printing apparatus 1 is excellent in esthetics.

In the middle of the passage 432, the curing heater 41 is arranged on a side of the recording medium 100, passing through the passage 432, onto which the ink is imparted, that is, a front surface side of the recording medium 100. The curing heater 41 irradiates infrared rays toward the ink on the recording medium 100 such that the ink is heated so as to be cured. Then, the ink is reliably fixed onto the recording medium 100 by the curing.

As illustrated in FIG. 3, the curing heater 41 has a tube 411 arranged along the y-axis direction, and a heating unit 412 inserted through the inside of the tube 411.

It is preferable that the tube 411 is configured of the metal material, particularly configured of iron. Furthermore, it is preferable that the total length of the tube 411 along the y-axis direction be sufficiently longer than the width of the recording medium 100 along the y-axis direction. Accordingly, it is possible to reliably irradiate infrared rays toward the entirety of the ink on the recording medium 100 passing through the lower part of the tube 411 (curing heater 41).

The heating unit 412 generates heat by electrification, and is configured of, for example, the electric heating wire such as the nichrome wire and the like. Then, the tube 411 is heated by the heating unit 412 generating heat, thereby irradiating infrared rays. Accordingly, the resin component in the ink is cured. Accordingly, a printed matter, that is, the recording medium 100 on which the ink is cured becomes excellent in weather resistance and friction resistance.

Furthermore, it is preferable that the surface temperature of the recording medium 100 when heating be, for example, within a range from 80 degrees to 120 degrees, and it is more preferable to be within a range from 90 degrees to 110 degrees.

In addition, it is possible to detect the surface temperature of the recording medium 100 by using, for example, an infrared ray sensor (IR sensor). Moreover, it is possible to set the surface temperature of the recording medium 100 to be within the above-mentioned range by properly switching ON/OFF of the curing heater 41 on the basis of the detection result of the infrared ray sensor.

As illustrated in FIGS. 4 to 8, the cooling fan 42 is arranged at the downstream side in the transportation direction with respect to the curing heater 41. The cooling fan 42 sends wind toward the recording medium 100 heated by the curing heater 41, thereby cooling off the recording medium 100.

Furthermore, as the cooling fan 42, similar as the blower fan 27 and the suction fan 28, for example, various kinds of fans such as a multi-blade fan and the like can be employed.

In the printing apparatus 1, the apparatus main body 2 and the curing unit 4 are connected to each other via the support mechanism 5. The support mechanism 5 is configured to rotatably (displaceably) support the curing unit 4 with respect to the apparatus main body 2. Accordingly, the curing unit 4 can rotate between a first position (see FIGS. 2 and 8) that is the closest position to the apparatus main body 2, and a second position (see FIGS. 1, 3 and 4) that is the separated position away from the first position.

Hereinafter, a state where the curing unit 4 is in the first position is referred to as the "folded state", and a state where the curing unit 4 is in the second position is referred to as the "unfolded state". Furthermore, when performing printing with the printing apparatus 1, the curing unit 4 is in the unfolded state to be in use. In addition, for example, when the printing apparatus 1 is transported, it is preferable that the curing unit 4 be in the folded state.

The support mechanism 5 has first plate members (one plate member) 6 that are respectively arranged at one end side (positive direction of y-axis) and the other end side (negative direction of y-axis) of the apparatus main body 2 (curing unit 4), second plate members (the other plate member) 7 that are provided to overlap the first plate member 6, a connection sections 8 that connect the first plate member 6 and the second plate member 7, and a tension spring 9 as a biasing member. The member at one end side of the apparatus main body 2 and the member at the other end side of the apparatus main body 2 have the same configuration, except that the plate members are symmetrically arranged regarding an axis that bisects the apparatus main body 2 at the center in the longitudinal direction. Therefore, hereinafter, the member at one end side will be representatively described.

Further, it is possible to easily and reliably perform the rotation operation by respectively arranging the above-described members at both sides of the apparatus main body 2.

As illustrated in FIGS. 4 to 8, the first plate member 6 is plate-shaped and a part of an edge thereof is bent. Therefore, a bent section 61 is fixed to the apparatus main body 2 via a plurality of bolts 11.

In addition, the first plate member 6 opposes a side surface 434 of the casing 43 of the curing unit 4, and is connected to the side surface 434 via a cylindrical-shaped axis member 10*a*. The axis member 10*a* becomes a rotational center when the curing unit 4 rotates.

The second plate member 7 is plate-shaped, and is arranged to overlap the outer side to the first plate member 6, that is, the opposite side of the side surface 434 side of the curing unit 4 of the first plate member 6.

Similar to the first plate member 6, the second plate member 7 also opposes the side surface 434 of the casing 43 of the curing unit 4. Then, the second plate member 7 is connected to the side surface 434 via a cylindrical-shaped axis member 10*b*. The second plate member 7 and the curing unit 4 can relatively rotate by the axis member 10*b* (see FIGS. 4 to 8).

Figure 4:
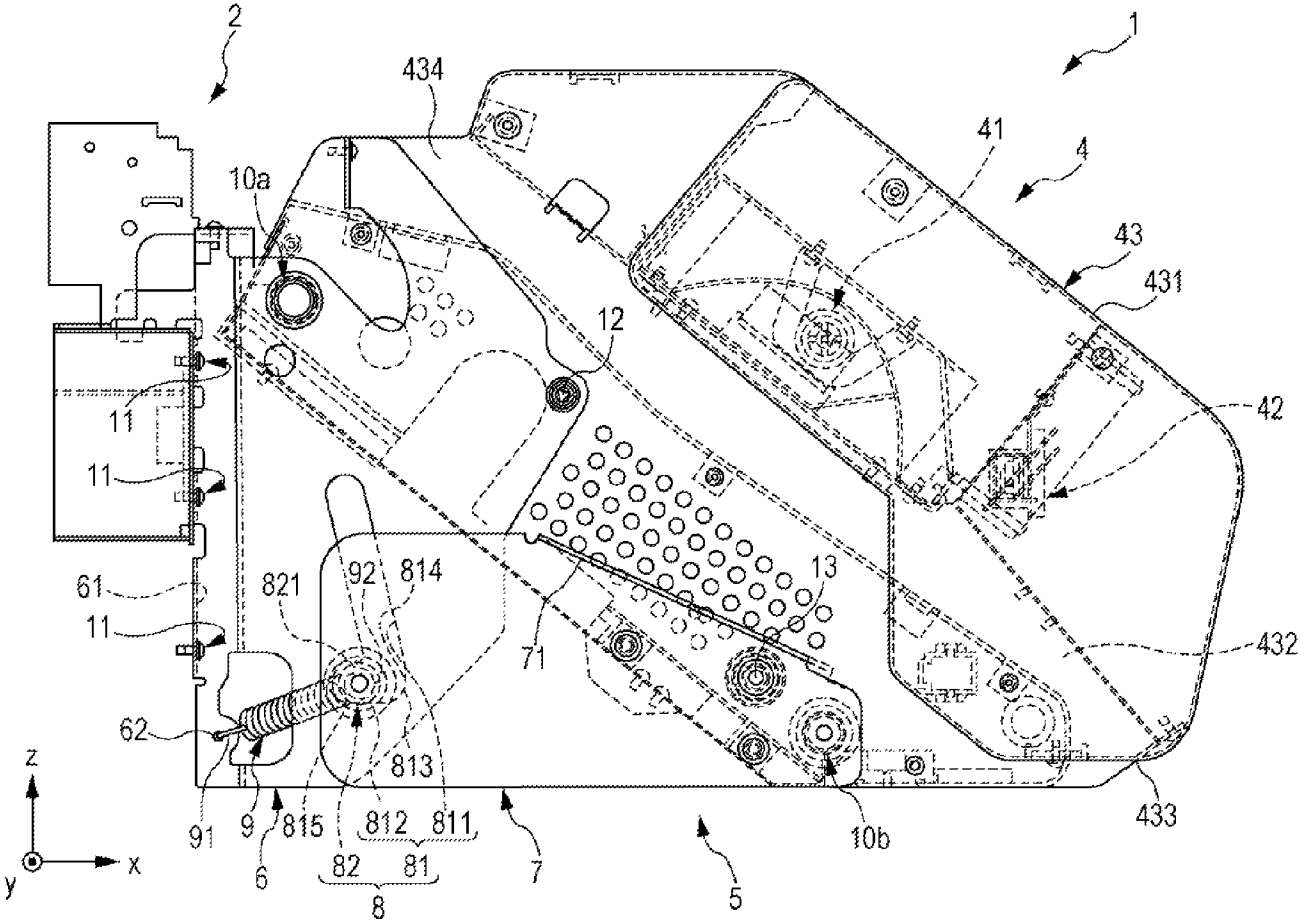
FIG. 4 is a side view illustrating an operation process of the printing apparatus of the aspect of the invention from a state illustrated in FIG. 1 to a state illustrated in FIG. 2 in that order.

Further, in the unfolded state in FIG. 4, the axis member 10*a* is located in the positive side of the z-axis from the axis member 10*b*, and the axis member 10*b* is also located in the positive side of the x-axis from the axis member 10*a*. In the folded state in FIG. 8, the axis member 10*a* is located in the positive side of the z-axis from the axis member 10*b*. In regard to the x-axis direction, the axis member 10*a* and the axis member 10*b* are in the substantially same position.

In addition, a bent section of which one portion is bent is formed in the edge of the second plate member 7. A bent section 71 functions as an operation lever that allows a finger to be placed onto, that is, to be held when the rotation operation is performed with respect to the curing unit 4.

As illustrated in FIG. 4, the curing unit 4 in the unfolded state is fastened through the first plate member 6 and a bolt 12, and the second plate member 7 and a bolt 13. Accordingly, the unfolded state is reliably maintained. Therefore, it is possible to prevent the curing unit 4 from inadvertently being in the folded state, while the printing apparatus 1 is in the middle of printing, and it is also possible to stably perform printing.

As the configuration material of the first plate member 6, the second plate member 7, and the axis members 10*a* and 10*b*, without being particularly limited, for example, it is preferable that a relatively hard metal material such as stainless steel and the like be employed.

The first plate member 6 and the second plate member 7 are connected via the connection section 8. The connection section 8 has a cam groove 81 that is provided in the first plate member 6, and a follower section 82 that is fixedly provided in the second plate member 7 and is inserted into the cam groove 81.

The cam groove 81 forms a substantially "L" shape in a plan view of the first plate member 6. The cam groove 81 is configured to include a first groove (vertical groove) 811, and a second groove (lateral groove) 812 that communicates with the first groove 811 and extends toward a direction which is substantially orthogonal (different direction) to the first groove 811.

Figure 8:
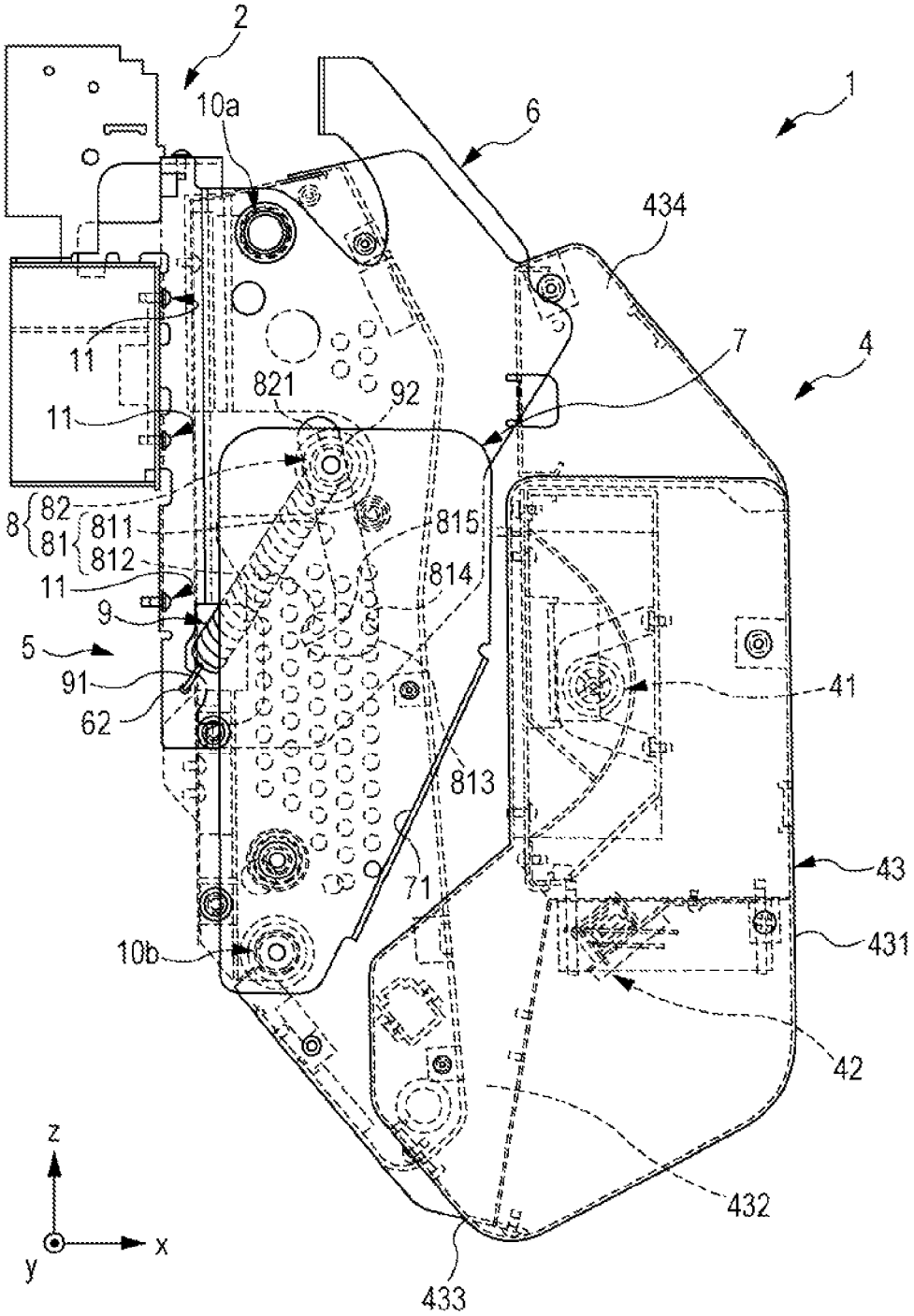
FIG. 8 is a side view illustrating the operation process of the printing apparatus of the aspect of the invention from the state illustrated in FIG. 1 to the state illustrated in FIG. 2 in that order.

As illustrated in FIG. 4, in the unfolded state, the follower section 82 is located in the second groove 812. In addition, as illustrated in FIG. 8, in the folded state, the follower section 82 is located in the first groove 811.

Then, in a translocation process from the unfolded state to the folded state, the follower section 82 moves along the extending direction thereof in the second groove 812, and reaches the first groove 811 via an intersection section 813 of the first groove 811 and the second groove 812. Meanwhile, in the translocation process from the folded state to the unfolded state, the follower section 82 reversely moves with respect to the aforementioned process.

The follower section 82 is configured to have a cylindrical member.

The tension spring 9 is a coil spring by which the follower section 82 is biased toward the apparatus main body 2 side. Hooks 91 and 92 are respectively formed at both end portions of the tension spring 9. The hook 91 is engaged with an engagement section 62 that is provided at a portion of the apparatus main body 2 side from the cam groove 81 of the first plate member 6 in a state where the tension spring 9 is tensed. The hook 92 is also engaged with an engagement section 821 that is provided in the middle of the follower section 82 in the longitudinal direction in a state where the tension spring 9 is tensed. Accordingly, it is possible that the follower section 82 is reliably biased toward the apparatus main body 2 side. Therefore, it is possible to reliably prevent the follower section 82 from inadvertently moving to the inside the cam groove 81.

As the configuration material of the tension spring 9, without being particularly limited, for example, it is possible to employ the stainless steel and the like.

Next, an operation process of translocation of the curing unit 4 from the unfolded state to the folded state, and an operation state of the support mechanism 5 will be described referring to FIGS. 4 to 8. The operation is, for example, preferable to be performed, for example, by two operators. Here, one out of the two operators is referred to as a "first operator", and the other operator is referred to as a "second operator".

[1] As illustrated in FIG. 4, the curing unit 4 is in the unfolded state, and the follower section 82 is located in the second groove 812 of the cam groove 81 in the support mechanism 5.

First, the first operator supports the vicinity of the center portion of the curing unit 4 from the lower side in the longitudinal direction to maintain the state. Then, the second operator respectively unscrews the bolt 12 that is fixed to the first plate member 6 and the bolt 13 that is fixed to the second plate member 7 and removes the curing unit 4.

Figure 5:
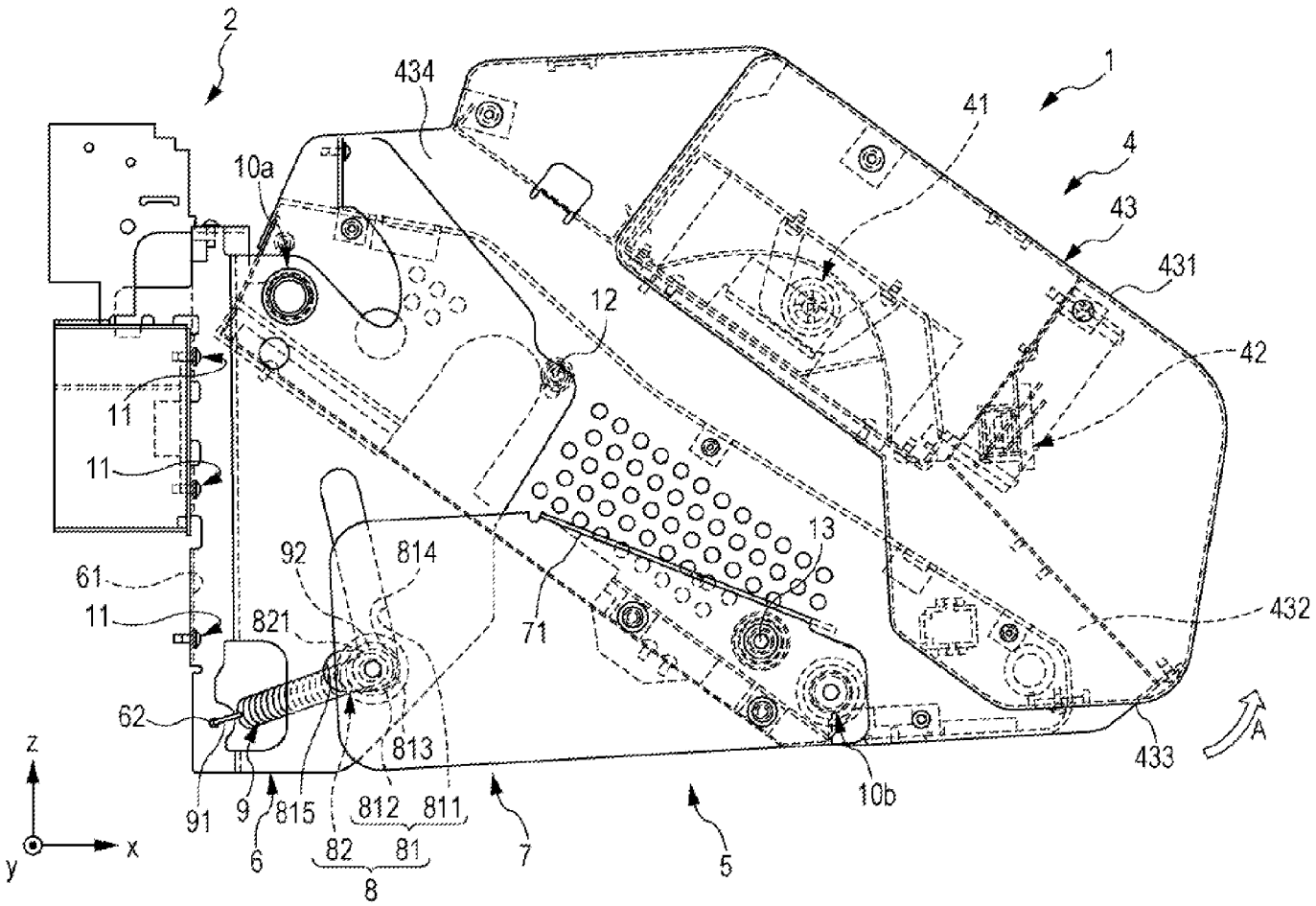
FIG. 5 is a side view illustrating the operation process of the printing apparatus of the aspect of the invention from the state illustrated in FIG. 1 to the state illustrated in FIG. 2 in that order.

[2] Next, as illustrated in FIG. 5, the first operator lifts up the curing unit 4 toward the arrow A direction in FIG. 5. At this time, in the support mechanism 5, the follower section 82 moves to the intersection section 813 of the cam groove 81 against the biasing force of the tension spring 9, and abuts on an edge section 814 that is located in front of the follower section 82 in a travel direction. Accordingly, lifting of the curing unit 4 is regulated.

Figure 6:
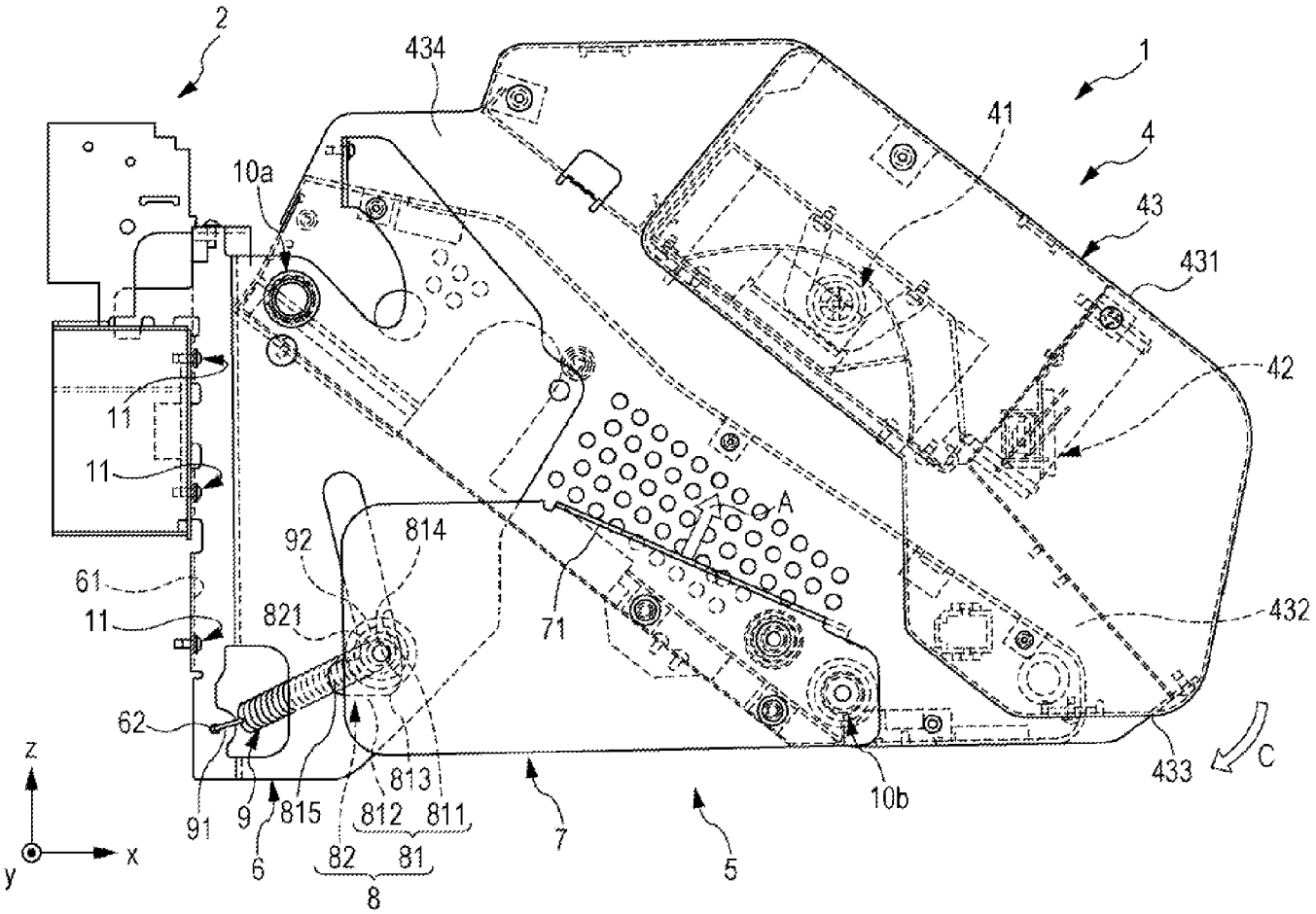
FIG. 6 is a side view illustrating the operation process of the printing apparatus of the aspect of the invention from the state illustrated in FIG. 1 to the state illustrated in FIG. 2 in that order.

[3] Next, as illustrated in FIG. 6, the first operator lifts up the bent section 71 of the second plate member 7 that is located in one end side of the apparatus main body 2 in the arrow A direction in FIG. 6. Then, similarly, the second operator lifts up the bent section 71 of the second plate member 7 that is located in the other side of the apparatus main body 2 in the same direction. Accordingly, each second plate member 7 respectively rotates about the axis member 10*b* clockwise in FIG. 6. At that time, the follower section 82 thrusts into the first groove 811 of the cam groove 81, thereby starting to move the first groove 811.

Likewise, in the printing apparatus 1, when the follower section 82 moves from the second groove 812 to the first groove 811, the bent section 71 of the second plate member 7 is operated so as to assist the movement thereof. Accordingly, the movement of the follower section 82 is reliably performed from the second groove 812 to the first groove 811. In addition, the movement is also prevented from being inadvertently performed. Therefore, the printing apparatus 1 becomes excellent in safety.

Then, the first operator and the second operator respectively support the curing unit 4 from the lower part, and gradually reduce the force thereof so as to rotate the curing unit 4 about the axis member 10*a* in an arrow C direction in FIG. 6.

Figure 7:
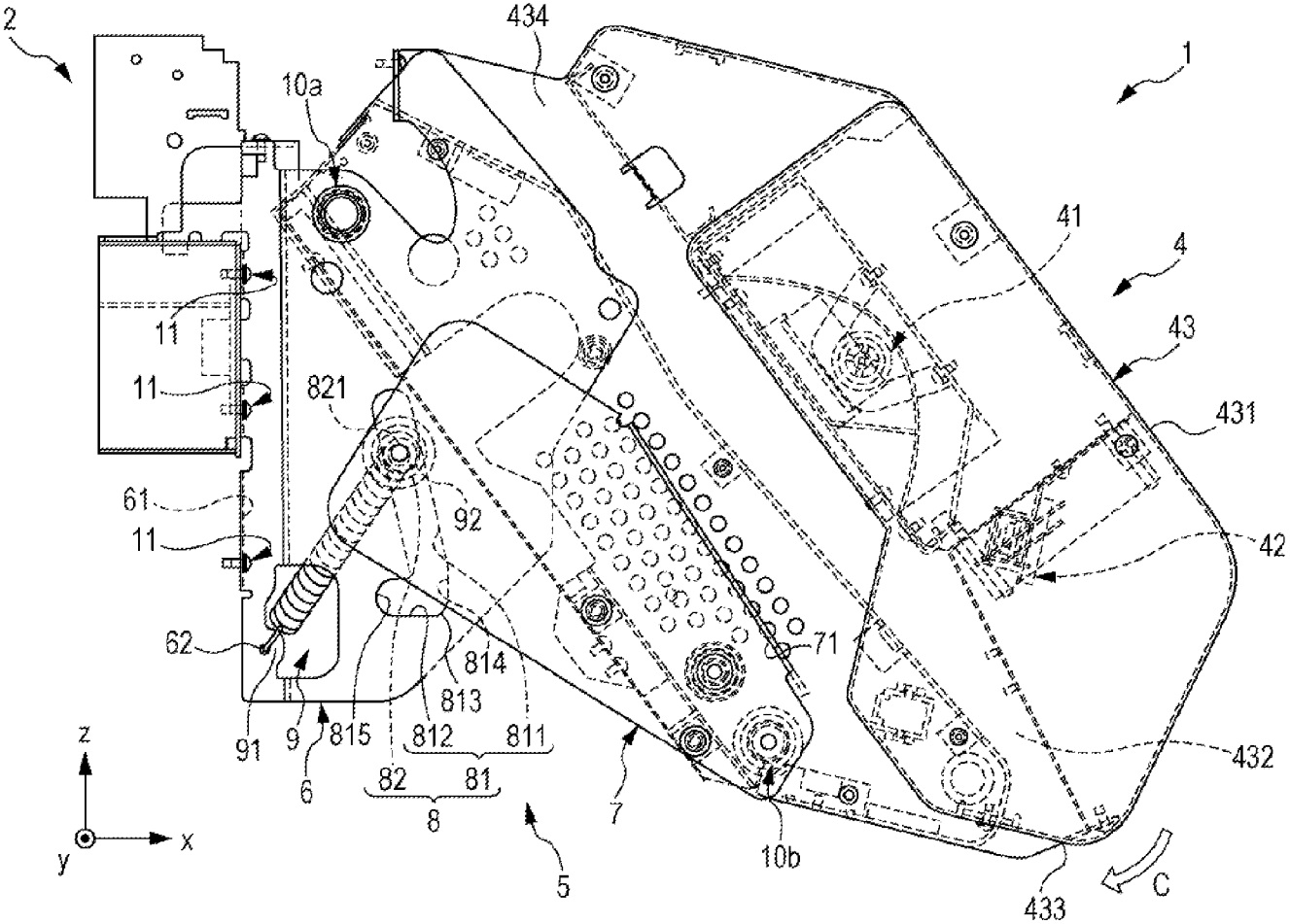
FIG. 7 is a side view illustrating the operation process of the printing apparatus of the aspect of the invention from the state illustrated in FIG. 1 to the state illustrated in FIG. 2 in that order.

[4] As illustrated in FIG. 7, if the curing unit 4 is further rotated about the axis member 10*a* in the arrow C direction in FIG. 6, the follower section 82 continues to move inside the first groove 811 accordingly.

[5] Then, finally, as illustrated in FIG. 8, the curing unit 4 is in the folded state, thereby completing the operation (work) by the first operator and the second operator.

Meanwhile, the operation process of translocation of the curing unit 4 from the folded state to the unfolded state, and the operation state of the support mechanism 5 is opposite to the above-described operation process. Further, although the operation is preferable to be performed by two operators, the operation can be performed by one operator.

In addition, when the curing unit 4 is translocated in the unfolded state, in the support mechanism 5, the follower section 82 thrusts into the second groove 812 of the cam groove 81 with a great force by a biasing force of the tension spring 9. At this time, the follower section 82 collides with an edge section 815 that is located in front of the travel direction thereof, and makes a sound. The collision sound is a notification sound that notifies the completion of the translocation in the unfolded state of the curing unit 4. It is possible to check that the curing unit 4 is reliably translocated in the unfolded state.

As illustrated in FIGS. 1 and 2, it is preferable that the total depth (total length along the x-axis direction) D of the apparatus main body 1 and the curing unit 4 be less than 750 mm in the folded state, and be within a range of 900 mm or greater and less than 1,000 mm in the unfolded state.

However, the width of an ordinary door is approximately 750 mm, even a relatively small door. When the printing apparatus 1 is carried in and out, the printing apparatus 1 needs to pass through the small door having the width of approximately 750 mm. In this case, if the curing unit 4 is in the folded state, the total depth D of the printing apparatus 1 becomes smaller than 750 mm. Therefore, the printing apparatus 1 can easily and reliably pass through the door.

Likewise, the printing apparatus 1 has an advantageous configuration when miniaturized, and can be easily carried in and out.

In addition, when the printing apparatus 1 is not in use after the printing apparatus 1 is carried into a room, the interior of the room can be commodiously utilized by causing the curing unit 4 to be in the folded state.

Hereinbefore, the printing apparatus of the invention is described referring to the illustrated embodiments. However, the invention is not limited thereto. Each section that configures the printing apparatus can be replaced with an arbitrary configuration which can perform similar functions. In addition, an arbitrary component may be added thereto.

In addition, the support mechanism is configured to rotatably support the curing unit with respect to the apparatus main body. However, without being limited thereto, the support mechanism may be configured to movably support the curing unit along the depth direction thereof with respect to the apparatus main body.

The first plate member, the second plate member, the connection section, and the tension spring that configure the support mechanism are respectively arranged in one end side and the other end side of the apparatus main body in the embodiment. However, without being limited thereto, the first plate member, the second plate member, the connection section, and the tension spring may be arranged in one side of either one end side or the other end side of the apparatus main body.

In addition, in the support mechanism, the cam groove is provided in the first plate member, and the follower section is provided in the second plate member in the embodiment. However, without being limited thereto, the follower section may be provided in the first plate member, and the cam groove may be provided in the second plate member.

This application claims priority to Japanese Patent Application No. 2012-232420 filed on Oct. 19, 2012. The entire disclosure of Japanese Patent Application No. 2012-232420 is hereby incorporated herein by reference.

What is claimed is:

1. A printing apparatus comprising:

an apparatus main body that has a transportation unit which transports a recording medium and a liquid droplet ejection head which ejects an ink onto the recording medium;

a curing unit that has a curing heater which heats and cures the ink on the recording medium; and a support mechanism that connects the apparatus main body and the curing unit, and displaceably supports the curing unit to be in an unfolded state and to be in a folded state where a depth which is the total length of the apparatus main body and the curing unit is shorter than that in the unfolded state in a direction orthogonal to the longitudinal direction of the apparatus main body, wherein the curing unit is used in the unfolded state.

2. The printing apparatus according to claim 1, wherein the depth is less than 750 mm when the curing unit is in the folded state, and 900 mm or greater when the curing unit is in the unfolded state.

3. The printing apparatus according to claim 1, wherein the support mechanism is configured to rotatably support the curing unit with respect to the apparatus main body.

4. The printing apparatus according to claim 3, wherein the support mechanism has a first plate member that is fixed to at least one of an end side and the other end side of the apparatus main body and connected to the curing unit, a second plate member that is provided to overlap the first plate member and connected to the curing unit, and a connection section that connects the first plate member and the second plate member.

5. The printing apparatus according to claim 4, wherein the connection section has a cam groove that is provided in one plate member of the first plate member and the second plate member, and a follower section that is provided in the other plate member and inserted into the cam groove.

6. The printing apparatus according to claim 5, wherein the cam groove has a first groove in which the follower section is located in the folded state; and a second groove which communicates with the first groove and extends toward a different direction from the first groove, and in which the follower section is located in the unfolded state.

7. The printing apparatus according to claim 6, wherein the other plate member has an operation lever that is operated in order to assist a movement of the follower section when the follower section moves from the second groove to the first groove.

8. The printing apparatus according to claim 5, wherein the support mechanism has a biasing member by which the follower section is biased toward the apparatus main body side.

9. The printing apparatus according to claim 4, wherein the curing unit is fastened to the first plate member and the second plate member via a bolt when the curing unit is in the unfolded state.

10. The printing apparatus according to claim 1, wherein the support mechanism is configured to generate a notification sound that notifies completion of a displacement when the curing unit is displaced from the folded state to the unfolded state.

11. The printing apparatus according to claim 1, wherein the curing unit has an embellished surface on which coating is applied, and the embellished surface faces a front side of the printing apparatus at any position of the folded state and the unfolded state.

12. The printing apparatus according to claim 1, wherein the curing unit is carried in and out in a displaced state of the folded state.

13. The printing apparatus according to claim 1, wherein the curing heater is arranged at a side of the recording medium onto which the ink is imparted, has a tube that is configured of a metal material, and has a heating unit that is inserted into the tube and generates heat by electrification.

* * * * *